US010182592B2

(12) United States Patent
Nakamura

(10) Patent No.: US 10,182,592 B2
(45) Date of Patent: Jan. 22, 2019

(54) FILTER MANUFACTURING MACHINE

(75) Inventor: Satoshi Nakamura, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 853 days.

(21) Appl. No.: 13/618,611

(22) Filed: Sep. 14, 2012

(65) Prior Publication Data

US 2013/0023395 A1 Jan. 24, 2013

Related U.S. Application Data

(63) Continuation of application No. PCT/JP2010/054430, filed on Mar. 16, 2010.

(51) Int. Cl.

| | |
|---|---|
| ***B31B 1/62*** | (2006.01) |
| ***A24D 3/02*** | (2006.01) |
| ***A24D 3/04*** | (2006.01) |

(52) U.S. Cl.

CPC ..... *A24D 3/022* (2013.01); *A24D 3/0233* (2013.01); *A24D 3/0279* (2013.01); *A24D 3/04* (2013.01)

(58) Field of Classification Search

None

See application file for complete search history.

(56) References Cited

U.S. PATENT DOCUMENTS 3,095,343 A * 6/1963 Berger ..... A24D 3/0233 131/343
3,637,447 A * 1/1972 Berger ..... A24D 3/0283 156/176
3,811,451 A * 5/1974 Berger ..... A24D 3/0225 131/339
3,847,064 A * 11/1974 Berger ..... A24D 3/0225 493/44
3,860,011 A * 1/1975 Norman ..... A24D 3/0279 131/198.1

(Continued)

FOREIGN PATENT DOCUMENTS

JP 53-130500 A 11/1978
JP 59-227286 A 12/1984

(Continued)

OTHER PUBLICATIONS

Extended European Search Report, dated Nov. 7, 2017, for European Application No. 17183241.3.

*Primary Examiner* — Hemant M Desai
*Assistant Examiner* — Mobeen Ahmed
(74) *Attorney, Agent, or Firm* — Birch, Stewart, Kolasch & Birch, LLP

(57) ABSTRACT

A filter manufacturing machine includes a feed path (7) configured to continuously feed a sheet material containing filter fibers and provided with a first plasticizer addition unit (9); a forming device (3) connected to a terminating end of the feed path (7) and configured to form the sheet material (6) into a hollow rod-shaped continuous filter body (11), the forming device including a tubular forming path for forming the sheet material (6) into the continuous filter body (11), a heat treating section for heating the sheet material, and a second plasticizer addition unit (14) arranged near the inlet of the tubular forming path; and a wrapping device (4) configured to receive the continuous filter body (11) delivered from the forming device (3) and wrap the continuous filter body in a wrapper to form a filter rod (19).

10 Claims, 2 Drawing Sheets

(56) References Cited

U.S. PATENT DOCUMENTS 4,022,221 A * 5/1977 Berger ..... A24D 3/0283 131/340
4,024,012 A * 5/1977 Sigmon ..... A24D 3/0279 156/201
4,109,666 A * 8/1978 Norman ..... A24D 3/0279 131/339
4,179,323 A * 12/1979 Sigmon ..... A24D 3/0279 156/201
4,291,711 A * 9/1981 Berger ..... A24D 3/043 131/336
4,344,382 A * 8/1982 Hausler ..... A24D 3/022 118/325
4,355,995 A * 10/1982 Berger ..... A24D 3/043 493/43
4,357,950 A * 11/1982 Berger ..... A24D 3/043 131/338
4,476,807 A * 10/1984 Pryor ..... D06B 3/045 118/300
4,525,385 A * 6/1985 Pryor ..... A24D 3/02 19/66 T
4,541,825 A * 9/1985 Hyde ..... A24D 3/0233 19/65 T
4,549,875 A * 10/1985 Pryor ..... A24D 3/022 493/44
4,648,858 A * 3/1987 Lewis ..... A24D 3/0279 156/441
4,770,193 A * 9/1988 Pryor ..... A24D 3/022 131/335
4,971,078 A * 11/1990 Deutsch ..... A24D 3/048 131/335
5,012,829 A * 5/1991 Thesing ..... A24B 15/281 131/335
5,129,409 A * 7/1992 White ..... A24B 15/165 131/360
5,954,061 A * 9/1999 Cardarelli ..... A24D 1/00 131/201
7,074,170 B2 * 7/2006 Lanier, Jr. ..... A24D 3/022 493/39
8,424,539 B2 * 4/2013 Braunshteyn ..... A24D 3/0283 131/336
2003/0173418 A1 * 9/2003 Koborinai ..... A24D 3/022 239/292
2004/0250823 A1 * 12/2004 Arnold ..... A24D 3/0233 131/331
2009/0260643 A1 * 10/2009 Libbra ..... A24D 3/0212 131/274
2009/0272389 A1 * 11/2009 Atwell ..... A24C 5/1821 131/59
2012/0115696 A1 * 5/2012 Davis ..... A24D 3/0212 493/39
2012/0122639 A1 * 5/2012 Davis ..... A24D 3/0204 493/39
2012/0291792 A1 * 11/2012 Treadaway ..... A24D 3/048 131/276
2014/0096785 A1 * 4/2014 Bailey ..... A24D 3/041 131/338

FOREIGN PATENT DOCUMENTS

JP 4-57954 A 2/1992
JP 2003-38157 A 2/2003
JP 2007-31865 A 7/2007
JP 2007-167065 A 7/2007

* cited by examiner

FILTER MANUFACTURING MACHINE

CROSS REFERENCE TO RELATED APPLICATIONS

This application is a Continuation of PCT International Application No. PCT/JP2010/054430 filed on Mar. 16, 2010, all of which are hereby expressly incorporated by reference into the present application.

TECHNICAL FIELD

The present invention relates to a filter manufacturing machine for making hollow filters from filter fibers.

BACKGROUND ART

A conventional filter manufacturing machine includes a storage vessel storing acetate tow for use as filter fibers, for example, and the tow (filter fibers) is fed from the storage vessel along a predetermined feed path. In the process of feeding, the tow is opened, spread, and formed into a sheet material. Subsequently, a plasticizer such as triacetin is added to the sheet material, and the sheet material is supplied to a rod forming device. In the rod forming device, the sheet material is formed into a rod, and the rod-shaped material is wrapped in paper to continuously form a filter rod.

The sheet material is formed into a rod by means of a part called forming tube. While passing through the forming tube, the sheet material is compressed and formed into a rod. There has been known a conventional technique whereby the sheet material is formed into a hollow cylindrical rod while passing through the forming tube.

In order to make a through hole in the rod, a mandrel is previously arranged inside the forming tube along the axis of the forming tube. The sheet material introduced into the forming tube is formed into a rod around the mandrel, continuously delivered, and pulled out of the mandrel, whereupon the rod with a through hole is obtained. It is, however, often the case that the tow projects from the surface of the through hole, and a filter rod with such a through hole is regarded as low in quality and rejected as a defective article. Also, if the surface region of the through hole of the rod is not satisfactorily high in hardness, the through hole is crushed when the filter rod is cut in a subsequent process, leading to lowering of the quality. In order to prevent crushing of the through hole, the amount of the plasticizer used may be increased to thereby increase the hardness of the filter. If the plasticizer is used in a large amount, however, a problem arises in that the filter itself is dissolved or gives off an offensive smell.

On the other hand, Patent Document 1 discloses an apparatus for manufacturing a hollow cylindrical filter rod. In this manufacturing apparatus, a tube is arranged along the axis of a filter rod to be formed, and tow is gathered around the tube and hardened to form a hollow filter. The apparatus, however, requires an additional member, namely, the tube, which leads to increase in the number of component parts. Also, a tube feed mechanism needs to be additionally provided, making the apparatus and its control complex.

PRIOR ART LITERATURE

Patent Document

Patent Document 1: U.S. Pat. No. 3,095,343

SUMMARY OF THE INVENTION

Problems to be Solved by the Invention

The present invention was made in view of the aforementioned conventional techniques, and an object thereof is to provide a filter manufacturing machine capable of manufacturing a filter in such a manner that tow is prevented from projecting from the surface of a through hole without the need to use a large amount of plasticizer and also that the through hole is not crushed when the filter is cut.

Means for Solving the Problems

To achieve the above object, the present invention provides a filter manufacturing machine comprising: a feed path configured to continuously feed a sheet material containing filter fibers; a first plasticizer addition unit arranged in the feed path and configured to add a first plasticizer to the sheet material on the feed path; a forming device connected to a terminating end of the feed path and configured to form the sheet material into a hollow rod-shaped continuous filter body and deliver the formed continuous filter body, the forming device including a tubular forming path allowing the sheet material to pass therethrough while narrowing the sheet material to form the sheet material into the continuous filter body, a heat treating section configured to heat the sheet material while the sheet material passes through the tubular forming path, and a second plasticizer addition unit arranged near an inlet of the tubular forming path and configured to spout a second plasticizer radially from an axis of the tubular forming path to add the second plasticizer to the sheet material; and a wrapping device configured to receive the continuous filter body delivered from the forming device, wrap the continuous filter body in a wrapper to form a filter rod, and cut the filter rod to obtain filter plugs.

Preferably, the forming device further includes a forming tube and a mandrel arranged inside the forming tube and cooperating with the forming tube to constitute the tubular forming path, the mandrel has one end portion located near an inlet of the forming tube, and the second plasticizer addition unit has a spray nozzle attached to the one end portion of the mandrel to spray the second plasticizer from the spray nozzle.

The second plasticizer is preferably sprayed from the spray nozzle in a forward direction of the tubular forming path.

Preferably, the forming tube has a peripheral wall through which a hole is formed to supply steam to the sheet material from outside of the forming tube.

The spray nozzle is preferably located upstream of the hole for supplying the steam, with respect to a direction in which the sheet material passes.

Preferably, the tubular forming path has a rounded configuration such that a diameter of an inlet section thereof gradually increases toward the inlet of the tubular forming path.

The second plasticizer is preferably sprayed only on a portion of the sheet material which comes into contact with the mandrel.

Preferably, the forming device includes a forming tube and a mandrel arranged inside the forming tube and cooperating with the forming tube to constitute the tubular forming path, and the mandrel includes a plasticizer flow channel axially extending therein to allow the second plasticizer to flow therein, a peripheral wall defining the plasticizer flow channel, and a plurality of jet holes formed through the peripheral wall to spout the second plasticizer therethrough.

Advantageous Effects of the Invention

According to the present invention, the forming tube is associated with the second plasticizer addition unit, and the second plasticizer is spouted outward from the axis of the forming tube. Consequently, the second plasticizer is added only to that portion of the sheet material which is to form the surface of a through hole of the hollow continuous filter body. In this manner, the second plasticizer addition unit for adding the second plasticizer to the sheet material is provided separately from the first plasticizer addition unit for adding the first plasticizer, and therefore, the plasticizer can be locally added only to that portion of the sheet material which needs to be increased in hardness. Thus, it is possible to prevent tow from projecting from the surface of the through hole without the need to use a large amount of the plasticizer, and also the through hole can be prevented from being crushed when the filter rod is cut.

The spray nozzle is attached to the end portion of the mandrel, and therefore, the spray nozzle and the mandrel form a unit and can be handled with ease. Also, since the mandrel is aligned with the axis of the forming tube, the second plasticizer sprayed from the spray nozzle can be directed accurately from the axis of the forming tube outward. The second plasticizer can therefore be reliably added to the portion which is to form the surface of the through hole.

Also, since the second plasticizer is sprayed from the spray nozzle radially in the forward direction of the tubular forming path, the plasticizer can be accurately and reliably added to the portion which is to form the surface of the through hole of the hollow continuous filter body. By restricting the spraying direction to the forward direction, the amount of usage of the second plasticizer can be further reduced.

Steam is applied to the sheet material through the hole formed through the peripheral wall of the forming tube, whereby the sheet material can be smoothly subjected to heat treatment.

Application of the second plasticizer enables efficient hardening of the sheet material.

Since the tubular forming path is configured such that the diameter of an inlet section thereof gradually increases toward the inlet of the forming path, the sheet material can easily enter the forming path, thus improving productivity.

The second plasticizer is locally sprayed only on that portion of the sheet material which is to form the surface of the through hole of the hollow filter. It is therefore possible to prevent the tow from projecting from the surface of the through hole without the need to use a large amount of the plasticizer, and also the through hole can be prevented from being crushed when the filter rod is cut.

Where the mandrel is configured to spout the second plasticizer directly therefrom, the second plasticizer can be locally and efficiently added to the portion which is to form the surface of the through hole of the hollow filter.

MODE OF CARRYING OUT THE INVENTION

Figure 1:
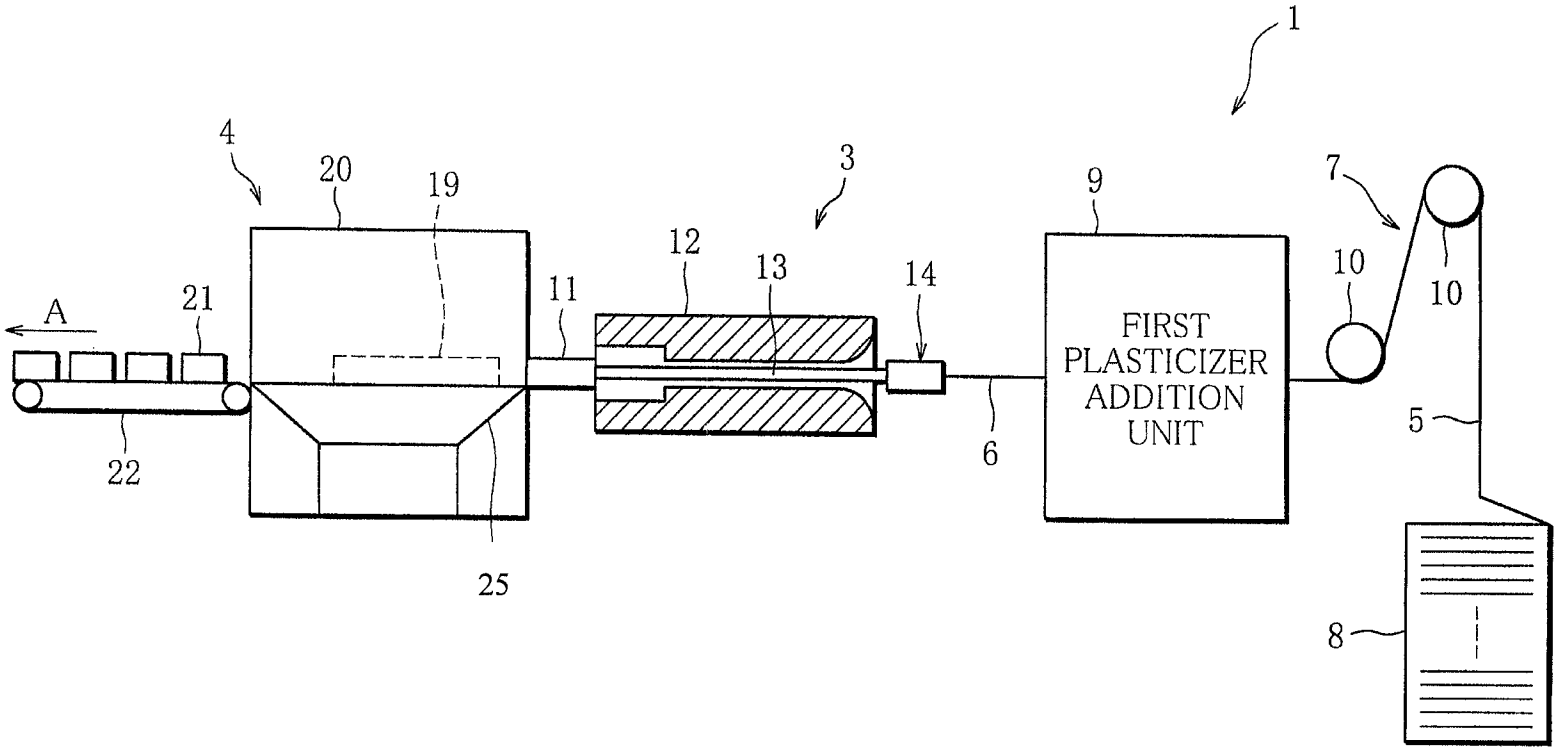
FIG. 1 schematically illustrates a filter manufacturing machine according to the present invention.

A filter manufacturing machine 1 illustrated in FIG. 1 includes a feed path 7, a forming device 3, and a wrapping device 4. The feed path 7 continuously conveys filter fibers (tow) 5 and a sheet material 6 containing the filter fibers 5. A storage vessel 8 storing the filter fibers 5, for example, cellulose acetate fibers, is arranged at a starting end of the feed path 7. The feed path 7 includes a plurality of (in the figure, two) guide rollers 10 and is connected to the forming device 3, described later. Also, the feed path 7 is provided with a first plasticizer addition unit 9. The first plasticizer addition unit 9 includes a conventionally known banding jet, a pair of pretension rollers and a pair of brooming rollers (none of which is shown), whereby the filter fibers 5 are opened and then formed into a sheet material. Further, the first plasticizer addition unit 9 is provided with a conventionally known sprayer (not shown) for adding a first plasticizer to the sheet material. As a result, the sheet material 6 is hardened to some extent.

Figure 2:
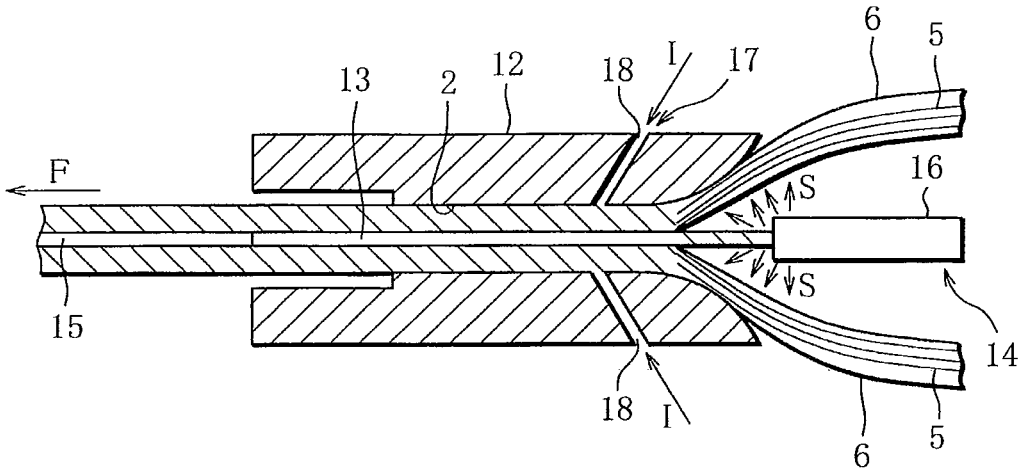
FIG. 2 is a schematic enlarged view of a forming device.

The feed path 7 is connected at its terminating end to the forming device 3 for forming the sheet material 6 into a hollow rod-shaped continuous filter body 11. As is clear from FIG. 2, the forming device 3 includes a forming tube 12, a mandrel 13, and a second plasticizer addition unit 14. The forming tube 12 is in the form of a hollow cylinder and allows the sheet material 6 to pass therethrough (in a direction indicated by arrow F in FIG. 2) while narrowing the sheet material 6. The sheet material 6 passes through a tubular forming path 2 in the forming tube 12. To stabilize the entry of the sheet material 6, the forming tube 12 may be configured such that an inlet section thereof has a gradually increasing inner diameter. Specifically, the tubular forming path 2 may have a rounded configuration such that the diameter thereof gradually increases toward the inlet. This makes it easier for the sheet material 6 to enter the tubular forming path 2, thereby improving productivity. A separate trumpet guide or the like may be used in order to obtain a similar effect. The mandrel 13 is arranged in alignment with the axis of the forming tube 12 and serves to make a through hole 15 in the continuous filter body 11. That is, the rod of filter fibers that has passed through the forming tube 12 has the through hole 15 corresponding in shape to the mandrel 13. The sheet material 6 is heat-treated in the forming tube 12 to be formed into the continuous filter body 11. The heat treatment is carried out by a heat treating section 17. In the illustrated example, the heat treating section 17 includes holes 18 formed through the peripheral wall of the forming tube 12, and steam is introduced through the holes 18 into the forming tube 12 (in directions indicated by arrows I in FIG. 2). Instead of steam, microwave or hot air may be used, or a different heat source such as electrically heated wire may be used.

The second plasticizer addition unit 14 is arranged near the inlet of the forming tube 12 and spouts a second plasticizer radially (in directions indicated by arrows S in FIG. 2) from the axis of the forming tube 12. Thus, the forming tube 12 is associated with the second plasticizer addition unit 14, and since the second plasticizer is spouted radially outward from the axis of the forming tube 12, the second plasticizer can be locally applied only to the inside of the sheet material 6 being fed into the forming tube 12. That is, the second plasticizer is added only to that portion of the sheet material 6 which later constitutes the surface of the through hole 15 of the continuous filter body 11 with the aid of the mandrel 13. Accordingly, only the surface of the through hole 15 of the continuous filter body 11 can be appropriately hardened, making it possible to reliably prevent the filter fibers from projecting from the surface of the through hole 15. Also, since the plasticizer is added only locally, an overall amount of usage of the plasticizer can be reduced, thus contributing to saving of resources. The continuous filter body 11 is thereafter wrapped in wrapping paper to obtain a filter rod, as described later, and when the filter rod is cut into filter plugs, the through hole 15 can be reliably prevented from being crushed at the cut ends of the filter plugs. In this manner, the second plasticizer addition unit 14 for adding the second plasticizer to the sheet material 6 is provided separately from the first plasticizer addition unit 9 for adding the first plasticizer, and it is therefore possible to locally add the plasticizer only to that portion of the sheet material 6 which needs to be increased in hardness. Also, dissolution of the filter fibers, which occurs when a large amount of plasticizer is used, can be prevented. The second plasticizer is added to the sheet material before the sheet material passes the heat treating section 17.

The mandrel 13 has one end portion located near the inlet of the forming tube 12, and a spray nozzle 16 of the second plasticizer addition unit 14 is attached to that end portion of the mandrel 13. The second plasticizer is sprayed from the spray nozzle 16. Since the spray nozzle 16 is attached to the end portion of the mandrel 13, the spray nozzle 16 and the mandrel 13 form a unit and can be handled with ease. Also, since the mandrel 13 is aligned with the axis of the forming tube 12, the second plasticizer sprayed from the spray nozzle 16 attached to the mandrel 13 can be directed accurately from the axis of the forming tube 12 outward. The second plasticizer can therefore be reliably added to the portion which is to form the surface of the through hole 15. Where the spray nozzle 16 is configured such that the second plasticizer is sprayed in a forward direction of the forming tube 12 in which the filter material advances within the forming tube 12, the second plasticizer can be accurately and reliably added to the portion which is to form the surface of the through hole 15 of the hollow continuous filter body. Also, where the direction of spraying the plasticizer is restricted to the forward direction of the forming tube 12, the amount of usage of the plasticizer can be further reduced.

Figure 3:
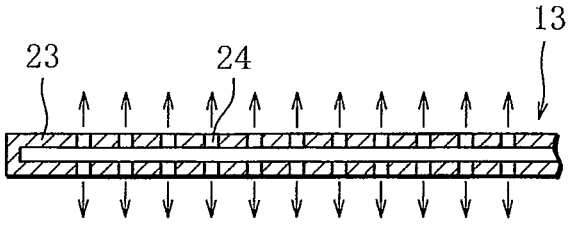
FIG. 3 is a schematic sectional view of another exemplary mandrel.

The second plasticizer addition unit 14 may alternatively be configured as illustrated in FIG. 3. Specifically, a hollow mandrel 13 is used, and the second plasticizer is introduced into the mandrel 13 so as to be spouted from jet holes 24 formed through a peripheral wall 23 of the mandrel 13, in directions indicated by arrows in FIG. 3. Since the second plasticizer is spouted directly from the mandrel 13, it is possible to add the second plasticizer efficiently and locally to the portion which is to form the surface of the through hole of the hollow filter.

The wrapping device 4 includes a rod forming section 20, where the continuous filter body 11 is cut to a predetermined length on a table 25, the resulting filter section is wrapped in wrapped paper (not shown) to form a filter rod 19, and the filter rod 19 is cut by a cutter (not shown) to obtain filter plugs 21. These steps are executed by using equipment conventionally known in the art. The filter plugs 21 are then supplied to a subsequent process (in a direction indicated by arrow A in FIG. 1) by a garniture belt 22.

EXPLANATION OF REFERENCE SIGNS

1 filter manufacturing machine
2 tubular forming path
3 forming device
4 wrapping device
5 filter fiber
6 sheet material
7 feed path
8 storage vessel
9 first plasticizer addition unit
10 guide roller
11 continuous filter body
12 forming tube
13 mandrel
14 second plasticizer addition unit
15 through hole
16 spray nozzle
17 heat treating section
18 hole
19 filter rod
20 rod forming section
21 filter plug
22 garniture belt
23 peripheral wall
24 jet hole

The invention claimed is:

1. A filter manufacturing apparatus comprising:

a feed path configured to continuously feed a sheet material containing filter fibers;

a first plasticizer addition unit arranged in the feed path and configured to add a first plasticizer to the sheet material on the feed path;

a forming device connected to a terminating end of the feed path and configured to form the sheet material into a hollow, rod-shaped continuous filter body, the forming device including:

a tubular forming tube for directing the sheet material to pass therethrough while narrowing the sheet material to form the hollow, rod-shaped continuous filter body;

a heat treating section provided in the tubular forming tube and configured to heat the hollow, rod-shaped continuous filter body while it passes through the tubular forming tube; and a spray nozzle arranged upstream of an inlet of the tubular forming tube and configured to introduce a second plasticizer radially from an axis of the tubular forming tube to add the second plasticizer to the sheet material;

a wrapping device configured to receive the hollow, rod-shaped continuous filter body delivered from the forming device, wrapping the hollow, rod-shaped continuous filter body in a wrapper to form a filter rod, and cutting the filter rod to obtain filter plugs;

an inlet section of the tubular forming tube having a diameter gradually increasing toward the inlet of the tubular forming tube;

a mandrel arranged inside the tubular forming tube, the mandrel extending through the tubular forming tube and cooperating with the tubular forming tube to define a tubular forming path; and a heat-supplying hole is formed in a peripheral wall of the heat-treating section to supply heat to the sheet material from outside of the tubular forming tube, wherein a first end portion of the mandrel is located more downstream from the heat-supplying hole, and wherein the spray nozzle is connected to a second end of the mandrel and is located upstream of the heat-supplying hole, the spray nozzle spraying the second plasticizer only on that portion of the sheet material which is adapted to come into contact with the mandrel.

2. The filter manufacturing apparatus according to claim 1, wherein the second plasticizer is sprayed forward from the spray nozzle with reference to the direction in which the sheet material advances.

3. The filter manufacturing apparatus according to claim 1, wherein:

the mandrel includes a plasticizer flow channel axially extending therethrough and is provided with a plurality of apertures to allow the second plasticizer to be introduced to an internal surface of the hollow rod-shaped continuous filter body.

4. The filter manufacturing apparatus according to claim 1, wherein the spray nozzle sprays plasticizer in a radial direction.

5. A filter manufacturing apparatus comprising:

a conveying system for introducing a sheet material containing filter fibers to a first plasticizer addition unit for introducing a first plasticizer to the sheet material, a forming device provided after the first plasticizer addition unit for forming the sheet material into a rod-shaped continuous filter body, said forming device including a forming tube and a mandrel axially aligned with and extending through the forming tube for forming an internal, hollow tubular path within the rod-shaped continuous filter body, said mandrel provided with a second plasticizer addition unit upstream of the forming tube adapted to introduce a second plasticizer to a surface of said internal, hollow tubular path, as it is being formed within said rod-shaped continuous filter body, a heat-treatment means for introducing heat to the forming tube immediately downstream of said second plasticizer addition unit, and a wrapping device configured to receive the rod-shaped continuous filter body delivered from the forming device, wrapping the rod-shaped continuous filter body to form a filter rod, and cutting the filter rod to obtain filter plugs, wherein the application of the second plasticizer to the surface of said internal, hollow tubular path as it is being formed prevents tow from projecting from the surface of the internal, hollow, tubular path and also strengthens the rod-shaped continuous filter body.

6. The filter manufacturing apparatus of claim 5, wherein the second plasticizer unit is a spray device which applies the second plasticizer to that portion of the sheet material which will come into contact with the mandrel, before the sheet material is advanced into the forming tube.

7. The filter manufacturing apparatus of claim 6, wherein the forming tube is provided with an expanded inlet portion which tapers toward an outlet of the forming tube.

8. The filter manufacturing apparatus of claim 5, wherein the mandrel contains an axially extending flow channel provided with a plurality of apertures to allow the second plasticizer to be introduced to the surface of the internal, hollow tubular path.

9. The filter manufacturing apparatus of claim 6, wherein the spray device is configured such that the second plasticizer is sprayed in the forward direction of the forming tube in which the rod-shaped continuous filter body is advancing, whereby the second plasticizer is reliably added to that portion which is to form the surface of the internal, hollow, tubular path.

10. The filter manufacturing apparatus of claim 9, wherein the heat-treatment means is a channel obliquely formed in the forming tube with respect to the forward direction of the forming tube.

* * * * *